United States Patent [19]

Gietz et al.

[11] Patent Number: 4,852,382

[45] Date of Patent: Aug. 1, 1989

[54] DIE STAMPING AND PUNCHING TOOL

[75] Inventors: Hanspeter Gietz, Gossau; Manfred Roesli, Herisau, both of Switzerland

[73] Assignee: Maschinenfabrik Gietz AG, Gossau, Switzerland

[21] Appl. No.: 165,306

[22] Filed: Mar. 8, 1988

[30] Foreign Application Priority Data

Apr. 8, 1987 [CH] Switzerland ..... 01357/87

[51] Int. Cl.[4] ..... B21J 9/18

[52] U.S. Cl. ..... 72/406; 72/451; 100/286

[58] Field of Search ..... 72/220, 406, 451; 100/286

[56] References Cited

U.S. PATENT DOCUMENTS

| | | | |
|---|---|---|---|
| 320,006 | 6/1885 | Shearer | 100/286 |
| 1,640,582 | 8/1927 | Smith | 72/406 |
| 3,182,588 | 5/1965 | Bolliger | 100/286 |
| 3,703,823 | 11/1972 | Wilson | 72/406 |

FOREIGN PATENT DOCUMENTS

| | | |
|---|---|---|
| 2049530 | 12/1980 | United Kingdom . |
| 2118090 | 10/1983 | United Kingdom . |

*Primary Examiner*—Lowell A. Larson

*Attorney, Agent, or Firm*—Walter C. Farley

[57] ABSTRACT

The die stamping and punching tool has a press upper part (18) and a tool plate (16) and a press lower part (13) with a stamping or pressing table (14) and counterpressure plate (15), the lower part being carried by toggle levers (11, 11') which are moved by a cam mechanism. The controlled rollable stamping or pressing table (14) with the counterpressure plate (15) and rolling profile has a device for controlling the stamping table movement comprising toggle levers (11, 11') and cam disks (12, 12') driving the same, the cam disks (12, 12') having a shape (A,B) related to the rolling profile. The stamping table can be guided by a further cam disk (29). This controllable stamping table guide preferably comprises a table guide lever (28) pivotable about a fulcrum. One end carries a slider (27) sliding in the stamping table and the other end is driven by the cam disk (29), which also has a shape (C,C') related to the rolling profile.

10 Claims, 4 Drawing Sheets

DIE STAMPING AND PUNCHING TOOL

The present invention relates to the field of the mechanical processing of flat material, particularly paper, cardboard, plastics, etc. by stamping, shaping punching, etc. using pressure and relates to a die stamping and punching tool.

BACKGROUND OF THE INVENTION

Die stamping tools serve to transfer random patterns to a flat material. Pure stamping operations can be carried out without additional materials, i.e. simple deformations to relief depth by pressure, or with additional materials, which consist of deformations with the simultaneous transfer of a composite material, generally in the form of a heat transfer. All these procedures take place under a relatively high pressure. This pressure action is produced in a press, e.g. by means of a toggle press, such as is e.g. represented in GB-A-No. 2 118 090 or GB-A-No. 2 049 530. The stamping table moved by means of the toggle lever has a flat or rounded counterpressure plate and can operate on a flat or rounded block plate, as a function of the design of the die stamping tool. If, for example, a composite material (foil) is applied to the surface to be stamped in a flat/flat process (planar counterpressure plate, planar block plate), then this process is unfavourable for stamping varnished material due to the formation of gas inclusions. Thus, use is made of rounded counterpressure plates, e.g. in the form of a part or complete cylinder.

Such stamping presses with round/flat characteristics are known (e.g. Heidelberg stamping cylinder model SP). However, they suffer from the disadvantage that as a result of the small cylinder radius only very low reliefs can be produced and the machine speed is very low. The radii of the curved plates are generally too small, because the control of the rolling of curves surfaces against flat surfaces causes problems as soon as there are divergences from cylindrical curvature and/or only limited curvatures occur, i.e. large radii are used.

SUMMARY OF THE INVENTION

An object of the present invention is to provide a stamping press avoiding the disadvantageous of rolling pressing (round/flat) and planar pressing (flat/flat), but which combines advantages of both. Thus, a squeezing out of gas is to be permitted during the stamping process at the desired pressures and with a simultaneously improved detachment of the pressed-on foils. A further objective is to retain the advantages of flat pressing (flat/flat) in the case of relief pressure.

Briefly described, the invention comprises a die stamping and punching tool machine comprising an upper press part, a tool plate carried by the upper press part and a lower press part including a rollable stamping table and a counter-pressure plate with a rolling profile. First and second toggle levers support the lower press part, each of the toggle lever means having a portion indepenently movable toward and away from a machine centerline to raise and lower an end of the lower press part relative to the upper press part. First and second cam disks are rotatably mounted adjacent the independently movable portions of the first and second toggle lever means, respectively, for acting against the movable portions to control the movement of the lower press part. The cam disks have cam shapes selected to move the respective ends of the lower press part and thereby cause a desired rolling movement pattern of the stamping table, the shapes including portions shaped to cause substantially linear movement of the table with time during a stamping phase of the movement. Drive means drives the cam disks in synchronism with each other so that predetermined portions of the cam shapes act against the movable portions of the toggle lever means concurrently. A stamping table guide slidably engages the stamping table for guiding the motion thereof and a third cam disk is operatively associated with the table guide for controlling the motion of the guide. The full force is transferred by cam-controlled toggle levers, together with a cam-controlled press table guide to the material being stamped. These bring about the raising and lowering and also the rolling between the block plate and the counterpressure plate. The controlled stamping table consequently also rolls the material to be stamped on the blocks, in order to obtain the desired pattern.

BRIEF DESCRIPTION OF THE DRAWINGS

The invention is described in greater detail hereinafter relative to embodiments and the attached drawings, wherein.

DESCRIPTION OF THE PREFERRED EMBODIMENTS

The discussed embodiment is based on a conventional toggle stamping press, in which the block plate is arranged in the top of the press and the counterpressure plate is mounted on a stamping table, which is in turn resting on a toggle lever-operated base. Essential to the invention are the control of the toggle lever, as well as the stamping table as a function of a rolling profile of said table. This profile can be located on a profile strip, on the counterpressure plate, or the block plate and optionally on both. The desired squeezing out of the gas is to take place quantitatively, but the pressing pressure must be able to simultaneously act on a maximum large working area or surface in order to retain relief pressability, i.e. the rolling stroke must be made as small as possible. For rolling purposes, this requires radii of 10 to 20 meters, i.e. very small curvatures.

The cam control of the toggle lever and the guide for the stamping table is designed in such a way that uniform rolling speed is obtained, which is not only important for a continuous squeezing out of the gas, but also for obtaining top quality stamping. As stated, the rolling process also leads to a better foil detachment and this is further improved in the case of a uniform rolling speed.

Figure 1:
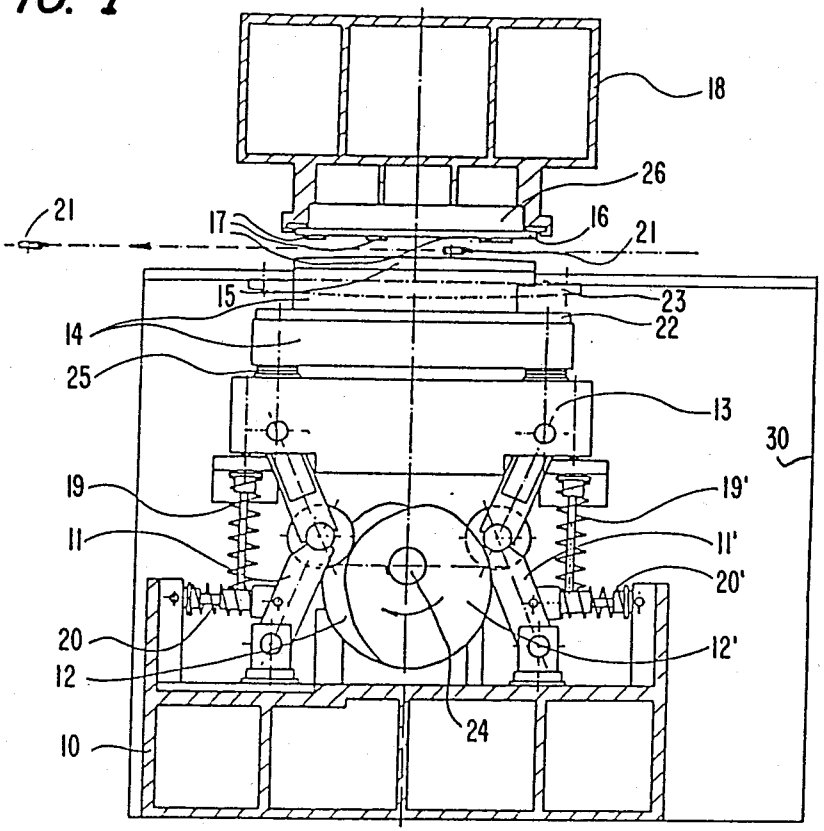
FIG. 1 is a side elevation, partly in section, of the stamping press with lowered counterpressure plate, which is moved by controlled toggle levers.

FIG. 1 shows a stamping press with a press upper part or top 18 for receiving a block plate 16 and, optionally including a heating device 26. A press lower part or base is connected to the top and has a toggle lever casing 10 of a toggle lever means 11 with springs, 11', 19, 19', 20, 20'. A base 13 mounted thereon, with a stamping table 14 is supported by a group of springs 25 resting on base 13 and, at the top, carries the counterpressure plate 15. The stamping table is shown in the lowered position, in which a gripper beam 21 can insert the material to be stamped between the block plate 16 and the counterpressure plate 15, the material itself not being shown.

FIG. 1 also shows in the vicinity of the toggle lever a drive shaft 24, on which are mounted cam disks 12, 12' driving the toggle lever. The curved shape of the two disks is shown in a random manner, the irregular periphery being intended to indicate that use is not made of the shape conventionally adopted for toggle presses. For planned guidance of the toggle levers, each of the two is driven by its own cam disk, 12, 12', which need not necessarily have the same shape. According to another embodiment the control mechanism on the stamping table includes pairwise arranged bearers 22, 23, of which only the front pair is visible. By using bearers 22, 23 with a corresponding shape, it is possible to improve the unwinding movement, in a similar way to that in the case of bearer rings on pressure rollers. The specially curved bearer can be mounted on the machine walls 30. Its curved shape is a function of the rolling path, but need not be identical with the shape thereof. By raising or lowering the bearers with respect to the rolling path, it is possible to move a stamping foil through the machine or its stamping area also at right angles to the sheet transportation direction. As a resulf of this displacement of the bearers from the rolling path (rolling profile) of the product, it is necessary to arrange the bearers so that they are displaceable with respect to the machine wall or the other fixing location in such a way that between the bearer and wall during the rolling of the bearer pair (upper and lower bearers), relative movement is possible, i.e. the movable bearer also moves along in controlled manner. Alternatively, a shaping of the rolling curve compensating this necessary relative movement is so provided on a bearer immovably fixed to the machine wall that no "slipping" is possible between the bearers during rolling.

Figure 4:
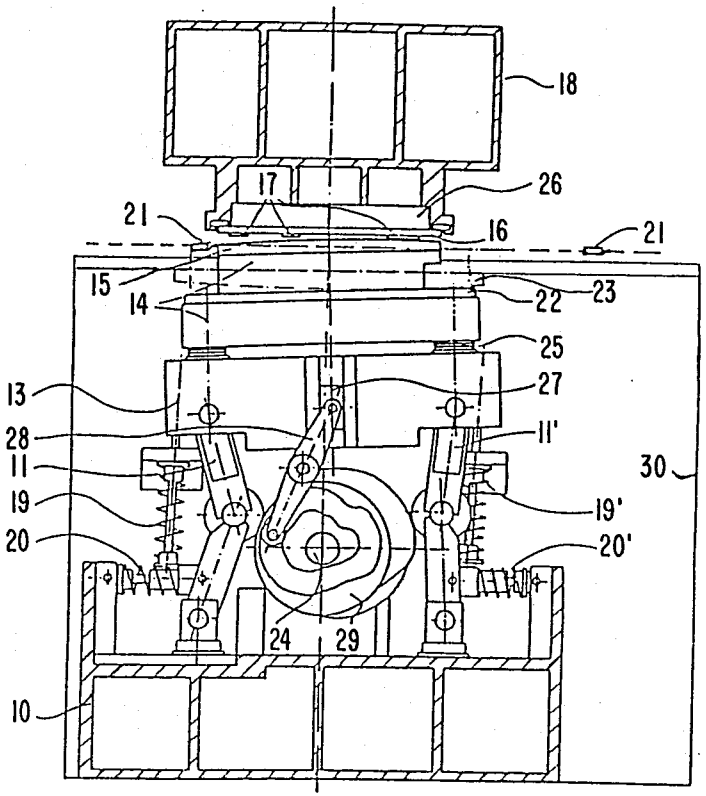
FIG. 4 is a side elevation, in partial section, showing a further embodiment with an additional press table guide.

The toggle lever deflections brought about by the two cam disks 12, 12' are a direct function of the curved shape of these two cam disks. In the case of a random control by means of both cam disks, the stamping table performs a tumbler movement within given limits. The two toggle levers act in the same way as two hinged supports, e.g. in the manner of articulated-mounted hydraulic cylinders, so that is is also advantageous to associate an additional guide with the stamping table, i.e. here the rigid connection of the two hinged supports, in the case of the desired control by the cams. This makes it possible to perform the desired rolling movement in an extremely accurate manner. For an embodiment of such a guide as shown in FIG. 4, there is a table guide mechanism 27, 28, 29, which is controlled in the same cycle as the toggle levers by its own cam. The link between this table guide mechanism and the other cam disks will be discussed hereinafter.

Figure 2:
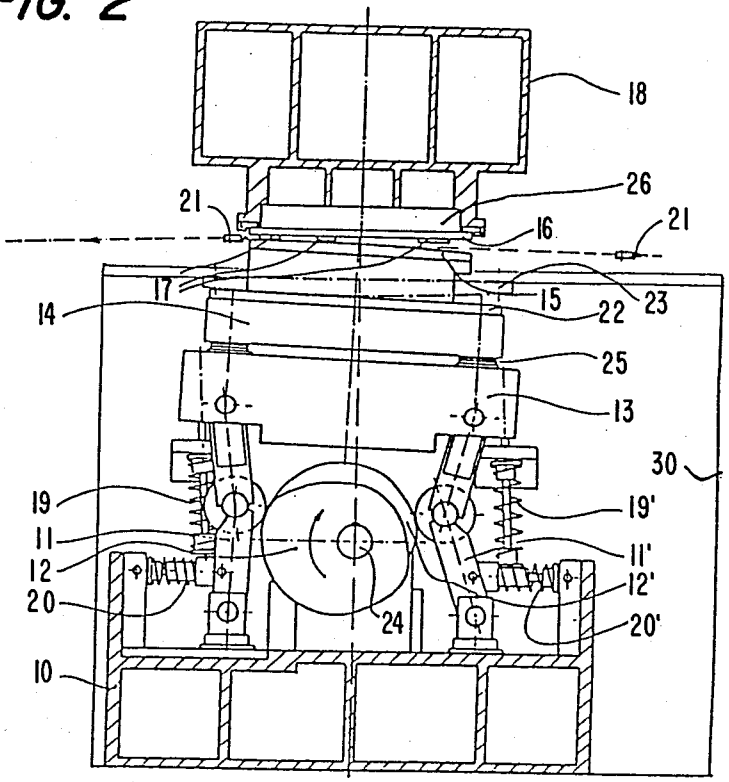
FIGS. 2 and 3 are side elevations, similar to FIG. 1, showing respectively, the stamping plate before and after the rolling of the counterpressure plate over the block plate.
Figure 3:
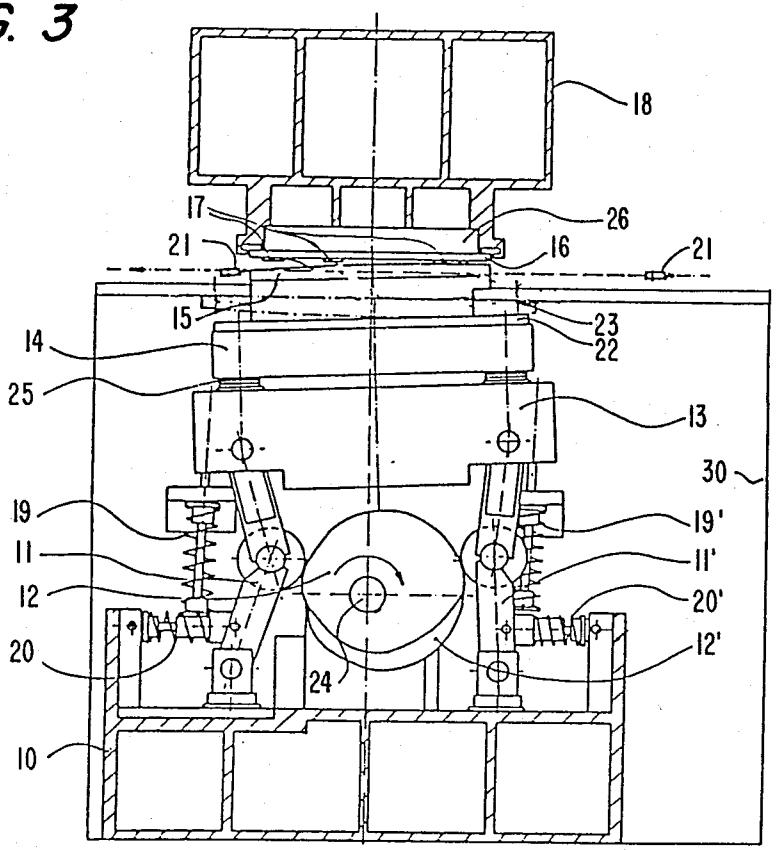

FIGS. 2 and 3 show the stamping press at the beginning and end of unwinding. After insertion of material to be stamped between the block plate 16 and the counterpressure plate 15, toggle lever 11 is deflected outwardly by cam 12 to such an extent that the bearers 22, 23 are in contact on one side and the full pressure is exerted as shown in FIG. 2. This pressure is a preloading pressure, i.e. the stamping table is at this moment already loaded, whilst the material for stamping is still not under pressure. As a result of the control of toggle levers 11, 11', the rolling of the bearer 23 on the opposite bearer 22 now commences accompanied by the simultaneous loading of the material for stamping, which is rolled in the same way against block plate 16 with blocks 17. This takes place by deflecting toggle lever 11 inwardly with the aid of pressure spring 20 and simultaneous by deflecting of toggle lever 11' outwardly with the aid of cam 12'. The end position after a complete rolling process is shown in FIG. 3, in which the conditions are reversed compared with FIG. 2. Cam disks 12, 12' then return the toggle levers and stamping table back to the position shown in FIG. 1 and a stamping cycle is completed.

The above-described rolling process can also take place directly on the material to be stamped without using bearers 22, 23. Without such a rolling guide, the stamping quality is directly dependent on the precise path of the stamping table. The material is then exposed to the stamping table or counterpressure plate operating without preloading, which is not disadvantageous so long as there are no disturbing influences. However, in both cases more marked tumbling, i.e. any uncontrolled movement in the horizontal direction or uncontrolled horizontal movements of the rolling sequence, leads to non-sharp stamping effects. Therefore, apart from the toggle lever control, an additional control table guide is advantageous.

FIG. 4 shows an embodiment of the aforementioned apparatus for the precise guidance of the stamping table. It here comprises a table guide lever 28 movable about a fixed rotation center. One end of lever 28 is guided in a cam 29 and the other end has a slider 27, which runs in a slideway in the stamping press base 13. Thus, the stamping table 14 has a "controlled movement path" and is defined in its position with respect thereto via a table guide cam. This representation also shows a randomly shaped table guide cam 29, in order to show that here again there is freedom of choice, namely a selected desired rolling function can be realized. However, it is easy to see that as a result of the table guide cam 29 of the table guide lever 28, the slider 27 is moved horizontally, so that the fulcrum of base 13 is also horizontally displaced and is also vertically displaced by the toggle lever deflection. The composite movement gives the actual (instantaneous) position of a point of the stamping table, whereof all the instantaneous positions in the form of a closed rotation loop give a function of the desired rolling. Thus, said means must be able to absorb the accelerating forces in the horizontal direction.

Using the presently discussed control means, it is possible to guide a stamping table with the material to be stamped along a precisely defined rolling path and it can simultaneously be subject to the action of a clearly defined normal force. During the unwinding movement no horizontal forces are exerted on the material to be stamped, so that, apart from the gas squeezing process, a completely sharp stamping effect can be obtained. From each position in the rolling process, normal forces now act on the material to be stamped (apart from mechanical clearance can be compensated through the use of the aforementioned bearers 22, 23.

The rolling path programmed on the drive shaft 24 by means of cam disks 12, 12', 29 is precisely performed by the stamping table, no matter whether or not there is a counterpressure through the block plate. It is the shape of the participating cam disks and not the shape of the counterpressure plate 15 which defines the rolling path.

Thus, the stamping table control of the die stamping and punching tool according to the invention is not dependent on the shape of the counterpressure plate. The latter need merely be shaped in such a way that the rolling of the stamping material on the flat block plate is possible, accompanied by simultaneous squeezing out of gas when pressing on foils and whilst retaining the relief stampability, or in other words it is not impeded. When using a planar counterpressure plate, then the block plate must have a corresponding curvature so as not to impede the rolling process, but it is conceivable for both to be curved.

Figure 5:
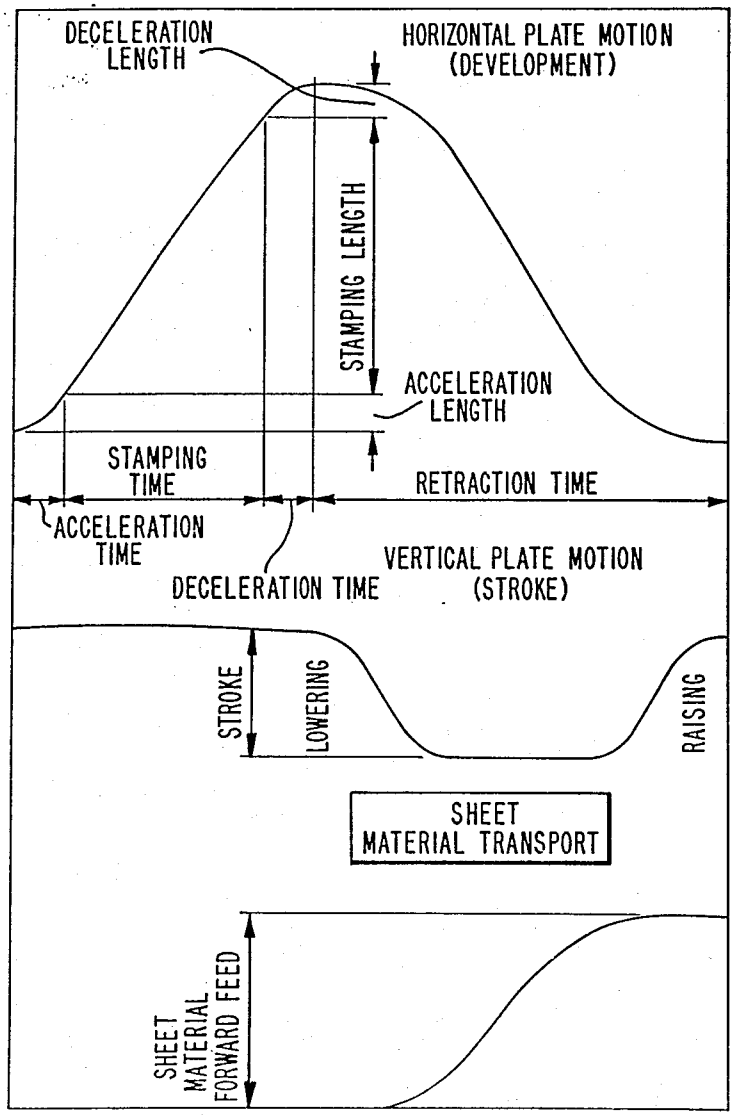
FIG. 5 is a graph illustrating certain movement sequences in the stamping station.

FIG. 5 shows the sequence graph over a cycle for the horizontal movement and the vertical movement of the rolling path of the stamping table for a typical operating case. The curved shape of the cam disks are chosen in such a way that the horizontal movement is as linear as possible over the entire stamping length as a function of time. Throughout the stamping phase of the process, there is no vertical stroke. Following a given time lag the stamping table is lowered, the material to be stamped is released, the movement process revealed and simultaneously a new material is inserted, the latter process being indicated by the bottom cam. Together the horizontal and vertical movements describe a closed "movement loop", whose shape is dependent on the curved shape of the participating cam disks, which will be discussed hereinafter.

Figure 6A:
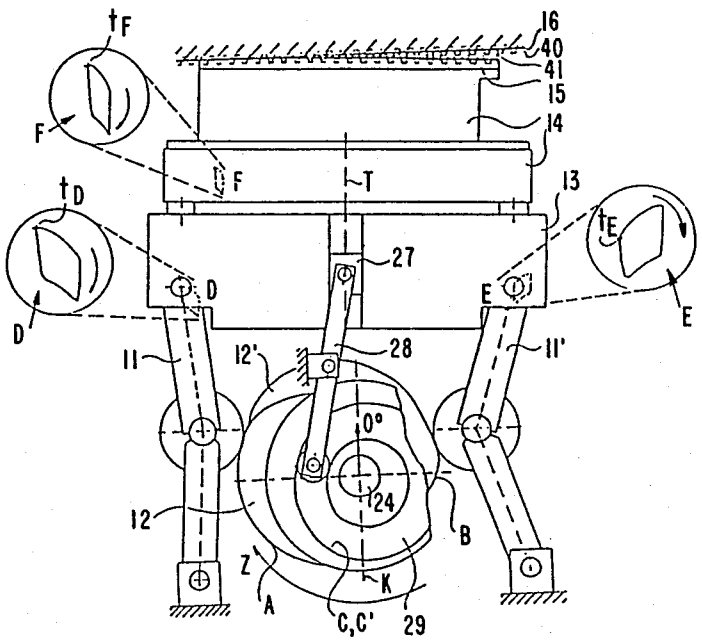
FIGS. 6*a*, 6*b*, and 6*c* are schematic side elevations of a press mechanism showing the sequential kinematic relationship between the links, the individual control cams and the movement of the stamping table.
Figure 6C:
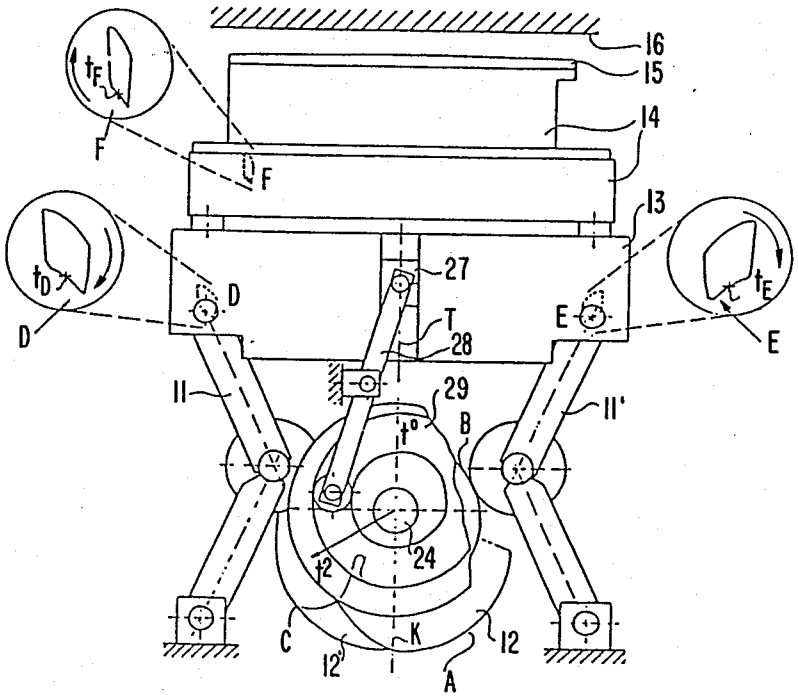
Figure 6B:
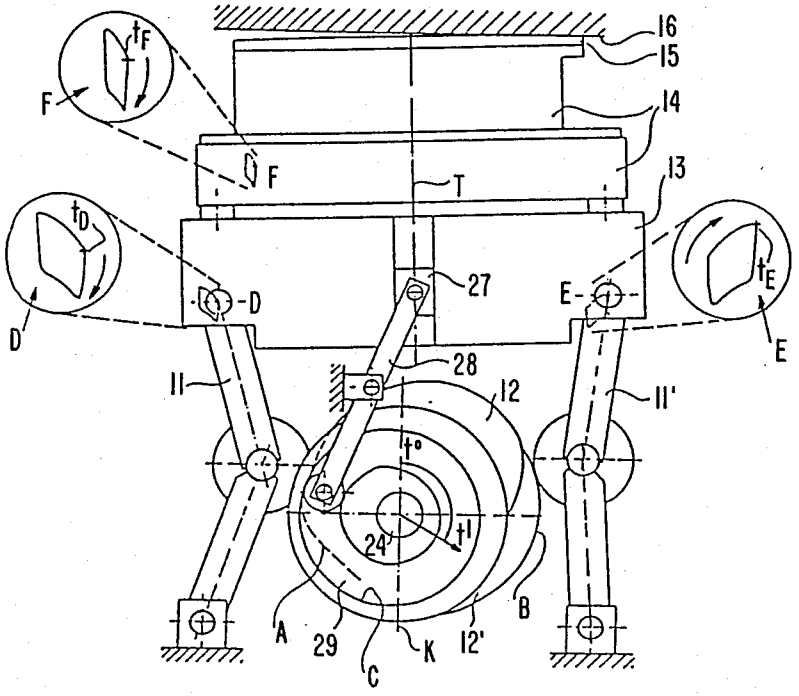

FIGS. 6*a*, 6*b* and 6*c* show an example of a movement sequence of the stamping table as a function of the drive cam disks 12, 12' and the table guide cam disk 29. The individual cams of the cam disks are designated A and B for the toggle lever-driving cams and C for the table-guiding cam, whilst D, E and F are three points on the base 13 and stamping table 4, whose positional change in the movement sequence is to be discussed.

The following representation is chosen for this. All three points D, E and F=f(A,B,C) are shown in enlarged form with their separate movement sequences. Each of these points describes a characteristic closed loop, which in the case of a clockwise drive rotation direction (rotation arrow Z in FIG. 6*a*) is also traversed clockwise by the selected point. The three figures show three instantaneous snapshots for each point D, E, F during such a passage. Points D and E are the axial points of the toggle lever articulation on base 13 and point F is an arbitrarily selected point on stamping table 14, whereby each random point on the counterpressure plate acts in the same way as f(A,B,C). In the upper curved part, the loops show a rolling curve followed, in the clockwise direction by a curved part describing the lowering of the stamping table, which is followed by the "roll-back curve", which then passes into the curved part bringing about the raising of the stamping table to the initial position. These curve loops are functions of the cam disks 12, 12' for the drive and the cam disk 29 for the table guide, which are all matched with one another, so that there is a movement unit of all three curves.

By modifying the table guide means 27, 28, 29, it is also possible to provide a positive tooth system in the rolling path on the product or outside the same (above or below). If the tooth system is arranged on the product outside the rolling path, then at least one tooth partner must be controlled relative to the stamping table, as discussed in conjunction with the bearers.

Such a self-closure or interlocking by a tooth system is preferably achieved by the arrangement of the pitch circle of a straight rack 40 (FIG. 6a) level with the block and the pitch circle of a rack 41 curved in accordance with the rolling profile in the rolling cam. The curvature of the curved rack 41 is related to the rolling profile and is determined by it. The thus obtained self-closure between the block plate and the stamping table absorbs the horizontal forces between the block and the stamping table. The self-closure can e.g. also be brought about by the construction of one tooth system on the block plate and another on the counterpressure plate.

In this embodiment with a table guidance by self-closure, as discussed hereinbefore, the table guide means 27, 28, 29 is slightly modified in such a way that the cam disk 29 has a cam C', which releases the table guide lever 28 during the rolling process during which the table guide is taken over by the positive tooth system to such an extent that there is no reciprocal hindrance between the self-closure and the control cam. Outside the rolling interval the cam disk 29 takes over the table guide and with its control cam C' ensures that at the start of the next rolling process the self-closure is reestablished with the correct pair of teeth. This prevents tumbling of the table and permits the clearly defined introduction of self-closure.

This embodiment is e.g. necessary if, as a result of constructional constraints, the pitch or division ratio of the table guide lever 28, i.e. the position of the fulcrum beteen the drive roller on the control cam and the slider in the table, is unfavourable.

The initial position is given on the drive shaft 24 at 0° and is drawn in the movement loops as tD, tE and tF. In FIG. 6*a* the counterpressure plate is top left at the start of rolling. The table guide lever 28 guided about a fulcrum, on initiating the rotary movement guides the slider 27 running in the base 13 backwards and forwards in time-dependent manner on a circular path, so that a vertical table axis T oscillates about a vertical foundation axis K and in this way accurately guides a movement in loop F and therefore brings about a clearly defined table movement. In FIG. 6*b*, the drive shaft is at t1°, where rolling is ended and the table starts to drop. In the movement loops these positions are designated tD, tE and tF at the end of the curved path describing rolling and FIG. 6*c* shows at t2° the rolling back of the stamping table 14, which passes through a symmetrically oriented position. The table and foundation verticals are aligned at this point.

The drive cams A,, B in the cam disks 12, 12' and the table guide cam C on te cam disk 29 are in accordance with the desired rolling cam on the bearers or the rolling course of the counterpressure plate.

In accordance with the desired rolling cam over the product are constructed the racks guiding the table or the positive measures guiding the table on the block plate and on the counterpressure plate (e.g. a tooth system). Cam C' is designed in such a way that during tooth engagement or meshing the table guide lever also freely rotates and outside tooth meshing is again controlled by cam C'.

As stated, the presently represented movement sequence is only an example of many possible rolling functions performed by the press table with the counterpressure plate in an exactly desired path, even if no pressure acts on the table and no material is being worked. Thus, there is not merely a rolling on a preshaped rolling path, such as would be the case e.g. with an unguided (uncontrolled) pressing along a shaped path. The link between the drive and control cams with respect to the rolling cam must be calculated anew in each case.

We claim:

1. A die stamping and punching tool machine comprising an upper press part; a tool plate carried by said upper press part; a lower press part including a rollable stamping table and a counter-pressure plate with a rolling profile; first and second toggle lever means for supporting said lower press part, each of said toggle lever means having a portion independently movable toward and away from a machine centerline to raise and lower an end of said lower press part relative to said upper press part; first and second cam disks rotatably mounted adjacent said independently movable portions of said first and second toggle lever means, respectively, for acting against said movable portions to control the movement of said lower press part, said cam disks having cam shapes selected to move the respective ends of said lower press part and thereby cause a desired rolling movement pattern of said stamping table including a portion shaped to cause substantially linear movement of said table with time during a stamping phase of said movement;

drive means for driving said cam disks in synchronism with each other so that predetermined portions of said cam shapes act against said movable portions of said toggle lever means concurrently;

a stamping table guide slidably engaging said stamping table for guiding the motion thereof; and a third cam disk operatively associated with said table guide for controlling the motion of said guide.

2. A machine according to claim 1 wherein said stamping table guide includes a guide lever mounted for pivotal movement about a fixed fulcrum, one end of said guide lever slidably engaging said stamping table and the other end thereof engaging said third cam disk, said third cam disk having a shape determined as a function of said rolling movement pattern.

3. A machine according to claim 2 and further including first and second toothed rack means on said upper and lower parts engageable with each other for restricting the relative horizontal motion therebetween during the stamping phase, said rack means being shaped to conform to said rolling movement pattern, and wherein said third cam disk includes a shaped cam portion for controlling the relative horizontal positions of said rack means at the time of engagement.

4. A machine according to claim 3 wherein one of said rack means comprises a curved rack and the other rack means comprises a straight rack.

5. A machine according to claim 3 wherein each of said first and second rack means comprises a curved rack.

6. A machine according to claim 3 wherein each of said first and second rack means comprises a lateral tooth system arranged on each of said block and counterpressure plate.

7. A machine according to claim 3 wherein one of said rack means is movable relative to said rolling movement pattern.

8. A machine according to claim 1 and further comprising first and second pairs of bearer members supported adjacent said stamping table, said bearer members being positioned to contact each other during the stamping phase.

9. A machine according to claim 8 wherein one bearer member of each pair is positioned above said counter-pressure plate and the other bearer member of each pair is positioned below said counter-pressure plate, one bearer of each pair being attached to said stamping table and having a curvature to conform generally to said rolling movement pattern.

10. A machine according to claim 9 wherein one bearer member of each pair is controllably movable toward and away from its support.

* * * * *